United States Patent [19]

Kondo et al.

[11] 4,313,486

[45] Feb. 2, 1982

[54] SAND MOLD-PRODUCING METHOD AND APPARATUS

[75] Inventors: Iwao Kondo; Toshiyuki Shioda, both of Obu, Japan

[73] Assignee: Kabushiki Kaisha Toyoda Jidoshokki Seisakusho, Aichi, Japan

[21] Appl. No.: 166,350

[22] Filed: Jul. 7, 1980

[30] Foreign Application Priority Data

Jul. 11, 1979 [JP] Japan ..... 54/88644

[51] Int. Cl.[3] ..... B22C 15/24

[52] U.S. Cl. ..... 164/38; 164/195; 164/200

[58] Field of Search ..... 164/19–22, 164/200–202, 38

[56] References Cited

U.S. PATENT DOCUMENTS 4,239,079 12/1980 Simmons ..... 164/200

FOREIGN PATENT DOCUMENTS 2814140 10/1979 Fed. Rep. of Germany ..... 164/202

619280 8/1978 U.S.S.R. ..... 164/200

*Primary Examiner*—Robert D. Baldwin

*Assistant Examiner*—K. Y. Lin

*Attorney, Agent, or Firm*—Burgess, Ryan and Wayne

[57] ABSTRACT

A sand mold-producing apparatus having a sand blower for vertically supplying sand with the help of a first flow of a pressurized air into a molding cavity in which a match plate carrying thereon a pattern is positioned, and an air injecting means for laterally injecting a second flow of a pressurized air having a pressure equal to or smaller than that of the first flow toward the pattern, so that the second flow of the pressurized air carries the sand toward every lateral pocketed pattern portion of the pattern and corners adjacent to the pattern during the supply of the sand into the molding cavity.

9 Claims, 3 Drawing Figures

SAND MOLD-PRODUCING METHOD AND APPARATUS

FILED OF THE INVENTION

The present invention relates generally to the production of a sand mold and, more particularly, relates to an improvement in a sand mold-producing apparatus of the type in which the direction of incoming of sand into a molding cavity or cavities of the apparatus is quite different from the direction of compacting or squeezing the sand within the molding cavities or the direction of parting the sand molds from a pattern or patterns after completion of the squeezing process. The present invention relates also to a method for carrying out the sand mold-production by the employment of the above-mentioned sand mold-producing apparatus.

BACKGROUND OF THE INVENTION

Diverse match plate molding machines are conventionally used for producing sand molds. One typical example of the match plate molding machine of the type in which the direction of incoming of sand into a molding cavity of a molding flask is at substantially right angles to the direction of squeezing the sand within the molding cavity is disclosed in Japanese Laid-Open patent application No. 54(1979)-110126. A description of the conventional match plate molding machine of the type disclosed in the above-mentioned Japanese patent application No. 54(1979)-110126, will be set forth hereinbelow with reference to FIG. 1.

In the conventional match plate molding machine illustrated in FIG. 1, a match plate 2 provided with a pattern 1 is brought into a molding position where the match plate 2 is tightly held between or sandwiched by a molding flask 3 for an upper mold and a molding flask 4 for a lower mold. The pair of molding flasks 3 and 4 are arranged in a working area established by a rigid machine framework having vertical columns 13 so that the molding flasks 3 and 4 are laterally movable toward and away from one another by the actuation of fluid cylinder devices along a horizontal guide 14. After completion of positioning of the match plate 2 and the molding flasks 3 and 4 into the molding position, a squeeze plate 5 for an upper mold and a squeeze plate 6 for a lower mold are laterally moved by the actuation of fluid cylinders 16 and 17 until the squeeze plates 5 and 6 come into respective predetermined positions inside the molding flasks 3 and 4. Thus, within both molding flasks 3 and 4, a molding cavity 7 for an upper mold and a molding cavity 8 for a lower mold are defined. At this stage, a telescopic sprue-forming rod 9 attached to the squeeze plate 5 is abutted against the match plate 2. Subsequently, sand is supplied from a sand blower 10 into the molding cavities 7 and 8 through a sand inlet port 11 formed in a part of a side wall of the molding flask 3 and a sand inlet port 12 formed in a part of a side wall of the molding flask 4. Upon completion of filling the molding cavities 7 and 8 with the sand, respective squeeze plates 5 and 6 are advanced by the actuation of respective fluid cylinders 16 and 17 toward the match plate 2 so that the filled sand within the molding cavities 7 and 8 is compacted or squeezed by the squeeze plates 5 and 6. It sould here be noted that the direction of incoming of sand from the sand blower 10 into respective molding cavities 7 and 8 is vertical, while the direction of squeezing the sand within the molding cavities 7 and 8 is horizontal. Therefore, as illustrated in FIG. 1, a horizontal and deep pocketed cavity A formed in the pattern 1 and corners B and C adjacent to the pattern 1 are not filled with a sufficient amount of the sand during the supply of the sand from the sand blower 10. As a result, even after completion of squeezing of the sand by the squeeze plates 5 and 6, frequently either a sand mold having a desired shape accurately complementary to the shape of the pattern 1 cannot be produced or collapsing of a sand mold occurs due to lack of physical strength of the mold during the parting process of the sand mold. Further cracks or breakage of a sand mold frequently occur during the pouring process, thus causing a defect or defects in a molded product. Therefore, in order to obviate the defects encountered with the conventional match plate molding machine of the type illustrated in FIG. 1, it is strongly desired to provide an appropriate method for enabling a sufficient filling of sand into the entire molding cavity of a molding flask, including a deep pocketed cavity or cavities of a pattern, as well as every corner of the pattern, for the purpose of eventually producing a sand mold having a high physical strength. It is further desired to devise an appropriate means for carrying out the above-mentioned method.

SUMMARY OF THE INVENTION

An object of the present invention is to provide an improvement in the sand mold-producing performance of a conventional match plate molding apparatus of the type in which the direction of incoming of sand into a flask cavity of a molding flask is different from that of the squeezing of the sand within the flask cavity.

Another object of the present invention is to provide a sand mold-producing apparatus capable of carrying out a sand mold-producing method which reliably results in sand molds having a high physical strength.

The present invention will become apparent from the ensuing description of a preferred embodiment of the present invention with reference to the accompanying drawings wherein.

Figure 1:
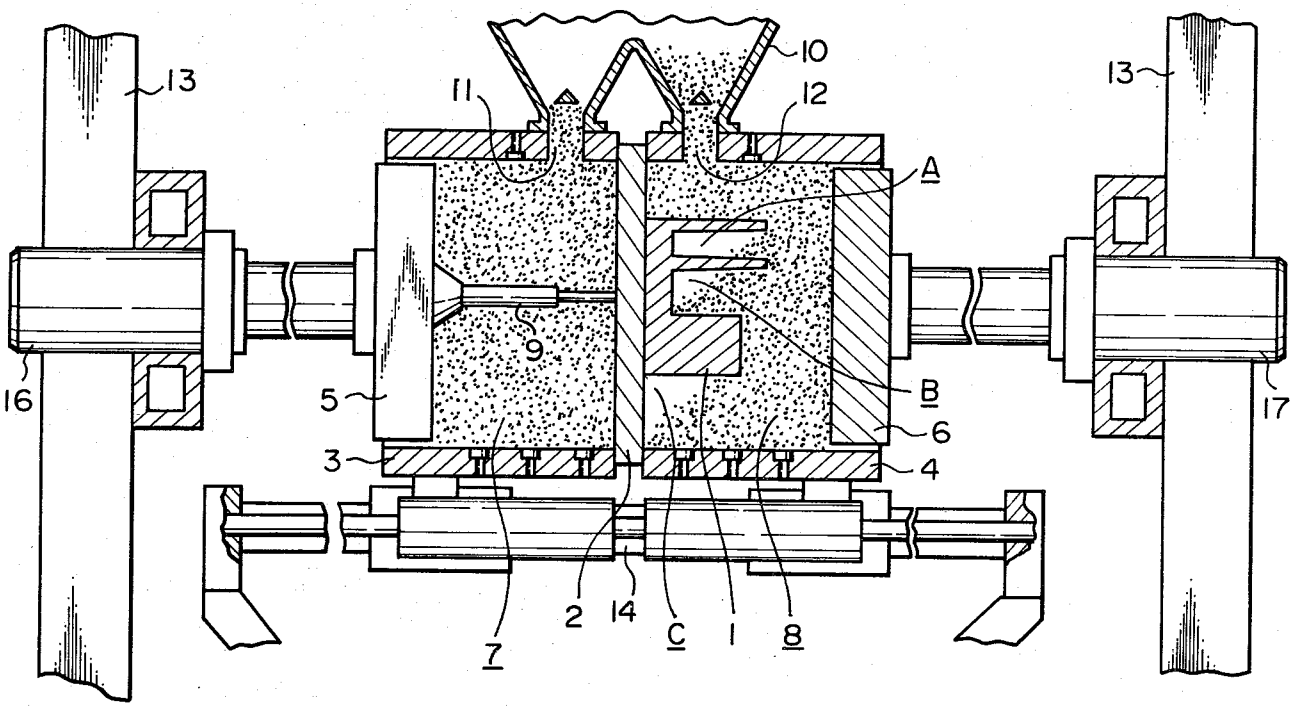
Fig. 1 PRIOR ART
FIG. 1 is a partial cross-sectional view of a conventional match plate molding apparatus.
Figure 2:
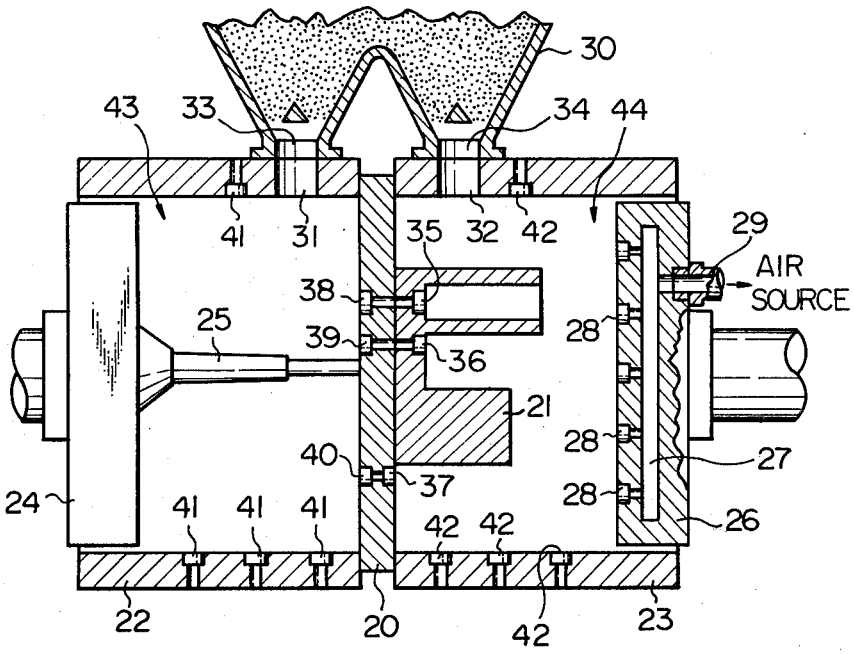
FIG. 2 is a partial cross-sectional view of an important portion of a sand mold-producing apparatus according to an embodiment of the present invention.

Referring now to FIG. 2, there is illustrated a match plate 20 of a sand mold-producing apparatus according to an embodiment of the present invention. The match plate 20 is provided with a pattern 21 having projecting pattern portions adjacent to which deep lateral pocketed portions and corners occur. The match plate 20 is arranged in a working area of the sand molding-producing apparatus, so that the match plate 20 is tightly held between a molding flask 22 for an upper sand mold and a molding flask 23 for a lower sand mold. The molding flasks 22 and 23 are horizontally movable toward and away from one another. Each of the molding flasks 22 and 23 has two open ends which are axially, horizontally spaced apart from one another and lie in respective vertical planes. When the molding flasks 22 and 23 are moved toward one another and tightly contact both faces of the match plate 20, the match plate 20 and the two molding flasks 22 and 23 are aligned and fixed by means of conventional positioning pins (not shown). A squeeze plate 24 for squeezing sand in the molding flask 22 is arranged so as to be able to move into and out of the molding flask 22 by the actuation of a conventional fluid cylinder device. The squeeze plate 24 is provided, on its inner surface, with a telescopic sprue-forming rod 25 which abuts against a surface of the match plate 20 when the squeeze plate 24 enters into the molding flask 22. A squeeze plate 26 for squeezing sand in the molding flask 23 is also arranged so as to be able to move into and out of the molding flask 23 by the actuation of another conventional fluid cylinder device. The squeeze plate 26 has, inside it, an air cavity 27 which is fluidly connectable to, on one hand, a flask cavity of the molding flask 23 via air injecting openings 28 formed in an inner surface of the squeeze plate 26 when the squeeze plate 26 enters into and is positioned within the molding flask 23, and; on the other hand, a pressurized air source (not shown) via an air conduit 29 and appropriate valve devices (not shown). The air injecting openings 28 are appropriately distributed on the inner surface of the squeeze plate 26 and are preferably structured as conventional vent holes fitted with well known vent plugs. A sand blower 30 is mounted on a framework of the sand mold-producing apparatus, and is provided with a pair of sand outlet ports 33 and 34 engageable with sand inlet ports 31 and 32 formed in side walls of the molding flasks 22 and 23, respectively. The sand blower 30 supplies sand into the molding flasks 22 and 23 under the effect of the pressure of a pressurized air applied by an appropriate pressure means to sand contained in the sand blower 30. As described previously, the pattern 21 of the match plate 20 has a protrudent pattern portion or portions, each having a pocketed portion adjacent to the protrudent pattern portion. Further, corners appear adjacent to the pattern 21. Preferably, as illustrated in FIG. 2, vent holes 35, 36 and 37 are provided in the pocketed portion and the corners, and are connected to vent holes 38, 39 and 40, respectively, provided in the opposite side of the match plate 20. Therefore, a flask cavity of the molding flask 23 is fluidly connected to a flask cavity of the molding flask 22, via the above-mentioned vent holes 35 through 40. Vent holes 41 are provided in the side wall of the molding flask 22 so as to fluidly connect the flask cavity of the flask 22 to the outside atmosphere, while vent holes 42 are provided in the side wall of the molding flask 23 so as to fluidly connect the flask cavity of the flask 23 to the outside atmosphere. All vent holes 35 through 42 are fitted with vent plugs having air-flow slits.

The operation of the sand mold-producing apparatus illustrated in FIG. 2 will be described hereinbelow.

Initially, the molding flasks 22 and 23 are moved toward one another until the match plate 20 is tightly sandwiched by the two flasks 22 and 23. Subsequently, the squeeze plates 24 and 26 are driven so as to enter into respective molding flasks 22 and 23. The squeeze plates 24 and 26 are stopped when the two plates 24 and 26 enter into the molding flasks 22 and 23 by respective predetermined axial distances from the outer open ends of the flasks 22 and 23. At this stage, closed molding cavities 43 and 44 enclosed by the match plate 20, the molding flasks 22 and 23, and the squeeze plates 24 and 26 are formed. Further, the sprue-forming rod 25 is abutted against the match plate 20. Subsequently, when the lower end of the sand blower 30 is engaged with the molding flasks 22 and 23 and when the sand outlet ports 33 and 34 are aligned with the sand inlet ports 31 and 32, the sand contained within the sand blower 30 is sent into the molding cavities 43 and 44 under the effect of a pressurized air until the molding cavities 43 and 44 are filled with the sand. This is the sand filling process. During the sand filling process, a pressurized air having a pressure equal to or smaller than the pressure of the pressurized air applied to the sand blower 30 is supplied from the pressurized air source into the cavity 27 of the squeeze plate 26 into the molding cavity 44 via the openings 28. Therefore, while the sand flows from the sand blower 30 into the molding cavities 43 and 44, the pressurized air in the cavity 27 of the squeeze plate 26 is laterally injected through the air injecting openings 28 into the molding cavity 44 toward the pattern 21 of the match plate 20. The pressurized air filling in the molding cavities 43 and 44 is, in turn, discharged from the vent holes 41 and 42 into the outside atmosphere. Thus, within the molding cavities 43 and 44, diverse flows of pressurized air occur. As a result, the sand vertically coming into the molding cavities 43 and 44 is carried by the flows of the pressurized air toward every corner of the molding cavities 43 and 44. It should be understood that, at this stage, since the cavity 44 is supplied with the pressurized air from the cavity 27 of the squeeze plate 26, within the molding cavity 44, lateral flows of the pressurized air which flow into the molding cavity 43 through the vent holes 35, 36 and 37 occur. As a result, the sand is carried by the lateral flows of the pressurized air toward the pocketed portions and the corners of the pattern 21 of the match plate 20. That is to say, the incoming sand vertically supplied from the sand blower 30 is guided by the flows of the pressurized air toward every pocketed portion and corner of the molding cavity 44, so that complete filling of the sand into the molding cavity 44 is accomplished. After completion of the filling of the sand into both molding cavities 43 and 44, the squeezing process is carried out. That is, either the squeeze plate 24 or 26 is fixed, and the other squeeze plate is further moved toward the match plate 20 so that the sand filling both molding cavities 43 and 44 is squeezed. Alternately, both squeeze plates 24 and 26 may simultaneously be moved toward the match plate 20. It should here be appreciated that during the squeezing process, a limited amount of free lateral movement of the molding flasks 22 and 23 and the match plate 20 is permitted, so that the squeezing movement of the squeeze plate 24 or 26 or both squeeze plates becomes smooth. After completion of the squeezing process, the parting process of sand molds is carried out in a conventional manner. As a result, the production of the sand molds is completed.

In the case of the embodiment illustrated in FIG. 2, one single pattern 21 mounted on the face of the match plate 20 facing the molding cavity 44 is employed. Therefore, in the other molding cavity 43, there is neither a pocketed pattern portion nor a corner which is filled with the incoming sand from the sand blower 30 by the help of the lateral flows of the pressurized air.

Figure 3:
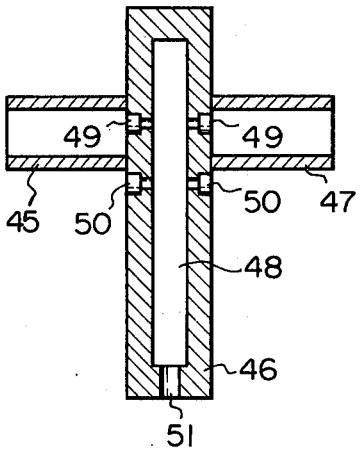
FIG. 3 is a cross-sectional view of an example of a match plate different from that shown in FIG. 2.

On the other hand, FIG. 3 illustrates a match plate 46 having two patterns 45 and 47 mounted on both faces of the match plate 46. If the match plate 20 of FIG. 2 is replaced by the match plate 46, the pattern 45 is positioned in the molding cavity 43 and the pattern 46 is positioned in the molding cavity 44. Therefore, in both molding cavities 43 and 44, there are pocketed pattern portions and corners which cannot be directly filled with the incoming sand from the sand blower 30. In this connection, the match plate 46 is so formed that there is inside it a cavity 48 which is fluidly connected to the pocketed pattern portion of the patterns 45 and 47 and to the corners adjacent to the patterns 45 and 47 via vent holes 49 and 50. The cavity 48 of the match plate 46 is also fluidly connected to the outside atmosphere via a vent hole 51. It should be understood that in the case where the match plate 46 is employed, the squeeze plate 24 should also be provided with an air injection means similar to the air injecting openings 28 and the air cavity 27 of the squeeze plate 26. The pressurized air within the molding cavities 43 and 44 can be discharged into the outside atmosphere through vent holes 49, 50 and 51. Consequently, lateral flows of the pressurized air for carrying the incoming sand toward the pocketed pattern portions and the corners adjacent to the patterns 45 and 47 occur. Accordingly, complete filling of the sand within both molding cavities 43 and 44 is achieved with certainty.

In the above-described embodiment, the match plate 20 having the pattern 21 or the match plate 46 having the patterns 45 and 47 is employed for concurrently producing upper and lower sand molds. However, it should be understood that the present invention is also applicable to an embodiment in which an upper and lower sand mold is produced at separate molding stations. Further, in the case of the match plate 20 having the pattern 21, shown in FIG. 2, the incoming sand from the sand blower 30 will be able to completely fill the molding cavity 44 by the help of the flows of the pressurized air injected from the squeeze plate 26 even if the vent holes 35, 36 and 37 are not formed in the match plate 20.

As will be understood from the above-mentioned description of the preferred embodiment of the present invention, the sand mold-producing apparatus of the present invention can ensure that the entire molding cavity or cavities are completely filled with the sand without any void being left. As a result, when the squeezing process is completed, the physical strength of the produced sand molds can be very high. Therefore, neither cracks nor flaws appear in the produced sand mold. Accordingly, molded products produced by the sand molds can be of high quality. Further, the sand mold-producing apparatus of the present invention is able to improve the productivity of producing the sand molds.

We claim:

1. A sand mold-producing apparatus comprising:

a stationary framework to provide a rigid construction for the apparatus and to establish a working area;

a sand blower means mounted on said framework and having at least a vertical sand supply port for vertically supplying sand under a first pressure of air;

at least one molding flask disposed in the working area, said molding flask having therein a flask cavity enclosed by a side wall formed with a sand inlet port connectable to the vertical sand supply port of said sand blower means and vent through-holes for connecting said flask cavity with the atmosphere, said molding flask further having two laterally spaced apart open ends lying in substantially vertical planes, respectively;

a match plate mounted for being mated in position with one of said open ends of said molding flask, said match plate mounting thereon a pattern which is positioned in the flask cavity of said molding flask when said match plate is mated with said one of said open ends of said molding flask;

at least a squeeze means comprising a squeeze plate and actuator means for actuating a lateral movement of said squeeze plate into and away from said flask cavity of said molding flask through the other open end of said molding flask, said squeeze plate comprising at least one horizontal air injection vent for flowing a pressurized air having a second pressure into said flask cavity toward said pattern of said match plate, and;

an air source means comprising a pressurized air source and a conduit means for supplying the pressurized air from said source to said air injection vent when said sand is being supplied into said molding flask.

2. A sand mold-producing apparatus according to claim 1, wherein said match plate has vent through-holes disposed adjacent to a lateral pocketed cavity formed in said pattern and a corner adjacent to said pattern, said vent through-holes of sand match plate connecting said lateral pocketed cavity and said corner to the outside atmosphere of said molding flask.

3. A sand mold-producing apparatus according to claim 1, wherein said squeeze plate of said squeeze means comprises an air holding cavity connected to said air injection vent and said air source means, said air holding cavity being provided for containing therein said pressurized air having the second pressure.

4. A sand mold-producing apparatus according to claim 1, wherein said second pressure of said pressurized air injected from said squeeze plate is equal to or smaller than said first pressure of said pressurized air for supplying said sand.

5. A sand mold-producing apparatus comprising:

a stationary framework to provide a rigid construction for the apparatus and to establish a working area;

a sand blower means mounted on said framework and having first and second vertical supply ports for vertically supplying sand under a first pressure of air applied to said sand blower means;

a pair of first and second molding flasks laterally arranged so as to be movable toward and away from one another, said first molding flask having therein a first flask cavity enclosed by a side wall formed with a sand inlet port connectable to said first vertical sand supply port of said sand blower means and vent through-holes for connecting said first flask cavity with the outside atmosphere, said first molding flask further having two laterally spaced apart open ends lying in substantially vertical planes, said second molding flask having therein a second flask cavity enclosed by a side wall formed with a sand inlet port connectable to said second vertical sand supply port of said sand blower means and vent through-holes for connecting said second flask cavity with the outside atmosphere, said second molding flask further having two laterally spaced apart open ends lying in substantially vertical planes;

a match plate mounted for being tightly sandwiched by said first and second molding flasks when both said molding flasks are moved toward one another, said match plate having at least one pattern attached thereto and positioned in either one of said first or second flask cavities;

a pair of first and second squeeze means for squeezing the sand supplied into said first and second molding flasks, said first squeeze means comprising a first squeeze plate and first actuator means for actuating a lateral movement of said first squeeze plate into and away from said first flask cavity of said first molding flask, said second squeeze means comprising a second squeeze plate and second actuator means for actuating a lateral movement of said second squeeze plate into and away from said second flask cavity of said second molding flask;

at least an air injecting means for injecting a pressurized air having a second pressure equal to or lower than said first pressure into one of said first and second flask cavities in which said pattern of said match plate is positioned, and;

an air source means comprising a pressurized air source and a conduit means for supplying the pressurized air having said second pressure from said source to said air injecting means when said sand is being supplied into said first and second molding flasks.

6. A sand mold-producing apparatus according to claim 5, wherein said air injecting means comprises at least one horizontal air injection vent formed in one of said first and second squeeze plates, and an air holding cavity formed in said one of said first and second squeeze plates.

7. A sand mold-producing apparatus according to claim 5 or 6, wherein said match plate has vent through-holes disposed adjacent to a lateral pocketed cavity formed in said pattern and a corner adjacent to said pattern, said vent through-holes of said match plate interconnecting between said first and second flask cavities.

8. A sand mold-producing apparatus according to claim 5, in which said apparatus comprises a pair of first and second air injecting means, wherein said first air injecting means comprises at least one horizontal air injection vent formed in said first squeeze plate and an air holding cavity formed inside said first squeeze plate, wherein said second air injecting means comprises at least one horizontal air injection vent formed in said second squeeze plate and an air holding cavity formed inside said second squeeze plate, and wherein said match plate has patterns attached thereto and positioned in both of said first and second flask cavities, and wherein said match plate has a cavity formed inside said match plate and a vent hole for connecting said cavity of said match plate to the outside atmosphere, said match plate further having vent through-holes disposed adjacent to lateral pocketed cavities formed in said pattern and corners adjacent to said pattern, said vent through-holes connecting said first and second flask cavities to said cavity of said match plate.

9. A sand mold-producing method using a machine including:

a sand blower for supplying sand with the help of a pressurized air;

at least one molding flask having a laterally extending side wall forming therein a flask cavity and vent holes connecting said flask cavity to the outside atmosphere, said molding flask further having two laterally spaced apart open ends lying in vertical planes, respectively;

a match plate carrying thereon a pattern and capable of being tightly mated with one of said two open ends of said molding flask, and;

a sand squeezing means for squeezing the sand in said molding flask, said method comprising the steps of:

supplying said sand from said sand blower through a sand inlet port formed in said side wall of said molding flask into said molding flask;

injecting a lateral flow of a pressurized air toward said pattern of said match plate at the same time as said supplying of said sand, and;

squeezing said sand in said molding flask after completion of said sand supply step.

* * * * *

UNITED STATES PATENT AND TRADEMARK OFFICE

CERTIFICATE OF CORRECTION

PATENT NO. : 4,313,486

DATED : Feb. 2, 1982

INVENTOR(S) : Iwao Kondo, et al

It is certified that error appears in the above—identified patent and that said Letters Patent is hereby corrected as shown below:

Col. 1, line 64: "sould" should be --should-- line 65: delete "of"

Col. 2, line 3 : "are" should be --is--

Col. 8, line 17: cancel "a" (second occurrence)

Signed and Sealed this

Fourth Day of January 1983

[SEAL]

*Attest:*

GERALD J. MOSSINGHOFF

*Attesting Officer*

*Commissioner of Patents and Trademarks*